United States Patent [19]

Hasenack

[11] Patent Number: 4,842,509

[45] Date of Patent: Jun. 27, 1989

[54] PROCESS FOR FUEL COMBUSTION WITH LOW $NO_x$ SOOT AND PARTICULATES EMISSION

[75] Inventor: Hendrikus J. A. Hasenack, Badhuisweg, Netherlands

[73] Assignee: Shell Oil Company, Houston, Tex.

[21] Appl. No.: 35,202

[22] Filed: Apr. 6, 1987

Related U.S. Application Data

[63] Continuation of Ser. No. 595,132, Mar. 30, 1984, abandoned.

[30] Foreign Application Priority Data

Mar. 30, 1983 [GB] United Kingdom ..... 8308830

[51] Int. Cl.[4] ..... F23D 11/00

[52] U.S. Cl. ..... 431/10; 431/8; 431/9; 431/175; 431/185; 431/187; 431/183

[58] Field of Search ..... 431/5, 8, 9, 10, 348, 431/351, 352, 354, 187, 188, 284, 158

[56] References Cited

U.S. PATENT DOCUMENTS

| | | | |
|---|---|---|---|
| 1,799,459 | 4/1931 | Fantz | 431/187 X |
| 2,405,465 | 8/1946 | Summerfield | 431/158 X |
| 2,532,709 | 12/1950 | Goddard | 431/158 X |
| 2,850,875 | 9/1958 | Gahwyler | 431/351 X |
| 3,044,539 | 7/1962 | Keating et al. | 431/10 |
| 3,118,489 | 1/1964 | Anthes | 431/9 X |
| 3,212,554 | 10/1965 | Blaha | 431/9 |
| 3,418,060 | 12/1968 | Spielman et al. | 431/158 |
| 3,914,091 | 10/1975 | Yamagishi et al. | 431/10 |
| 3,993,449 | 11/1976 | Childs | 431/8 X |
| 4,050,879 | 9/1977 | Takahashi et al. | 431/174 |
| 4,297,093 | 10/1981 | Morimoto et al. | 431/10 |
| 4,500,281 | 2/1985 | Beardmore | 431/10 |

FOREIGN PATENT DOCUMENTS

| | | | |
|---|---|---|---|
| 61512 | 5/1981 | Japan | 431/351 |
| 134612 | 8/1982 | Japan | 431/351 |
| 1422977 | 1/1976 | United Kingdom . | |
| 1530260 | 10/1978 | United Kingdom | 431/187 |

*Primary Examiner*—Samuel Scott
*Assistant Examiner*—Carl D. Price

[57] ABSTRACT

The emission of NOx, soot and particulates is minimized by combusting fuel in two sequential steps, viz. a first combustion step wherein a number of fuel jets and a substoichiometric amount of combustion air in the form of an equal number of high-velocity air jets are injected into a combustion chamber in such a manner that (a) each fuel jet merges into one high velocity air jet, (b) the characteristic mixing time of each fuel jet is less than about $10^{-4}$ sec, and (c) a plurality of separate fuel/air jets is generated forming at ignition a plurality of primary flames in which a residence time for the fuel of substantially at least 100 ms is maintained;

and a second combustion step comprising introducing further combustion air into said combustion chamber for complete combustion of the fuel.

10 Claims, 4 Drawing Sheets

FIG. 2
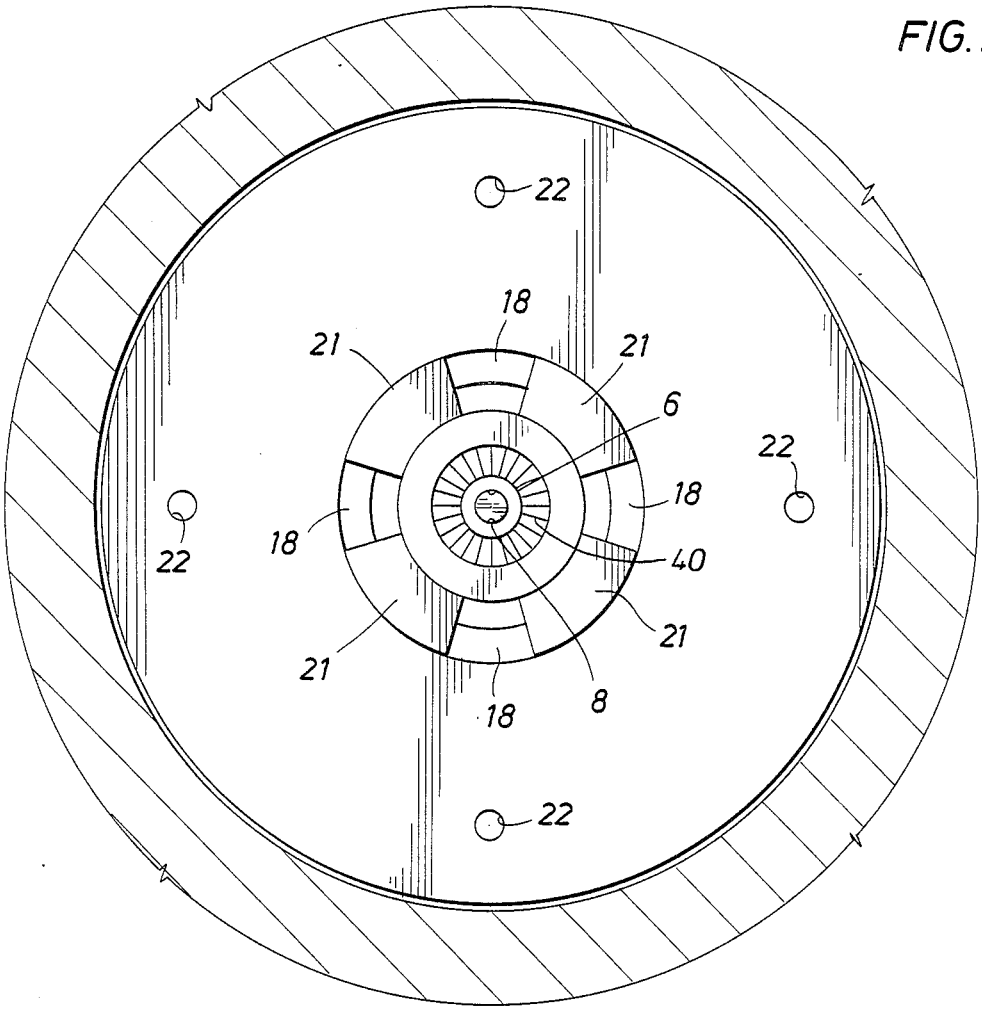
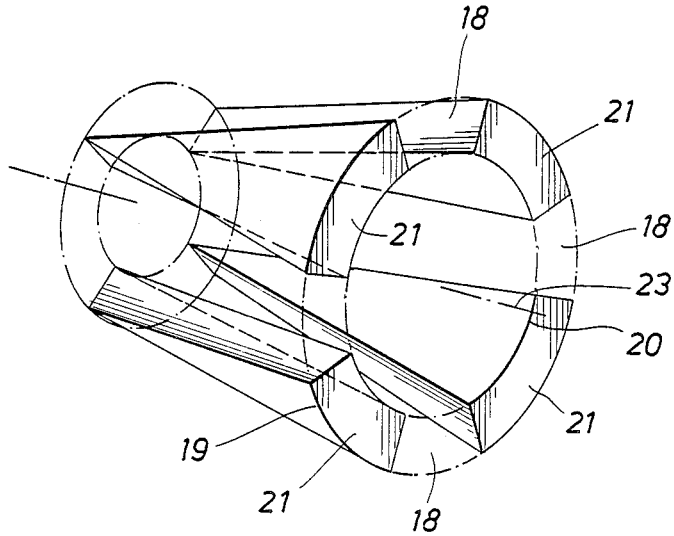
FIG. 3

PROCESS FOR FUEL COMBUSTION WITH LOW $NO_x$ SOOT AND PARTICULATES EMISSION

This is a continuationof application Ser. No. 595,132, filed Mar. 30, 1984, now abandoned.

BACKGROUND OF THE INVENTION

The present invention relates to a method and an apparatus for fuel combustion with low emission of $NO_x$, soot and particulates, and is particularly suited to combustion of very heavy products with relatively high pollution potential.

There is currently a growing trend to convert hydrocarbonaceous fluids to valuable products and to reduce the quantity of less valuable products. Refineries are being equipped with advanced conversion units, which are designed to increase the amount of distillate from a given feedstock. In consequence of this practice, the bottom products generated become ever heavier, with higher residual carbon content and fuel nitrogen concentrations. Since these bottom products still have a certain quantity of thermal energy, it is worthwhile to use these products in combustion equipment in combination with steamboilers, furnaces, and the like.

Increase of the residual carbon content and fuel nitrogen concentration of the fuels to be fired may involve an important problem, in that such increases are normally associated with higher $NO_x$, soot and particulates emission when applying currently available combustion equipment. Especially in highly industrialized areas, the emission of NOx, soot and particulates may be assumed to increase drastically in the forthcoming years, if special measures are not taken. This fact explains the growing need for preventing pollution of the atmosphere due to excessive emission of the above unhealthy substances.

There are, in principle, two solutions possible for dealing with this problem. The first solution is the cleaning of the flue gases prior to emission into the atmosphere. This solution is, however, very expensive since very special cleaning equipment and processes are necessary, and the cleaning processes themselves reduce the efficiency of the total installation. The second option for reducing emission of $NO_x$, soot and particulates is to improve the combustion processes and equipment in such a manner that the generation of these pollutants is minimized or considerably reduced. In order to reduce soot and particulates emission, the mixing intensity of the fuel and the combustion air may be enlarged. In this way, successful attempts have been made in the past for reducing soot and particulate emissions from combustion units. Furthermore, methods have already been developed for reducing $NO_x$ emissions. It has, however, been found that attempts to reduce $NO_x$ emissions are, in general, associated with an increase in soot and particulates emissions. In this context, it is noted that, in the past, burners for low $NO_x$ emission have been proposed which are able to operate at a very low combustion air velocity and able to atomize the fuel sufficiently. A proper atomization of heavy fuel can only be attained with a high atomizing steam consumption. For this type of low air velocity burner, the particulate emissions can be kept rather constant when reducing the $NO_x$ emissions. Such a burner will, however, be sensitive to fouling when fired in a vertical position due to the applied high atomization of the fuel. The low combustion air velocity which should prevail suggests the use of a burner with a relatively large diameter, which will produce non-uniform heat flux distributions. A further disadvantage of this type of burner is imposed by the fact that the required high atomizing steam consumption reduces the fuel economy considerably.

Since there will be a growing supply of fuel with an increased residual carbon content in the future, the available combustion methods will most probably become insufficient for meeting the environmental requirements without substantially reducing combustion efficiency. It is, therefore, an object of the invention to provide a fuel combustion method suitable for heavy fuels in which method the emissions of $NO_x$, soot and particulates are minimized or considerably reduced when compared with known combustion methods, without adversely affecting the fuel economy.

SUMMARY OF THE INVENTION

Accordingly, the fuel combustion process of the invention comprises a first combustion step wherein a number of fuel jets and a substoichiometric amount of combustion air in the form of an equal number of high-velocity air jets are injected into a combustion chamber in such a manner or under such conditions that (a) each fuel jet merges into one high velocity air jet, (b) The characteristic mixing time of each fuel jet is less than about $10^{-4}$ sec, and (c) a plurality of separate fuel/air jets is generated forming at ignition a plurality of primary flames in which a residence time for the fuel of substantially at least 100 ms is maintained; and a second combustion step comprising introducing further combustion air into said combustion chamber for complete combustion of the fuel.

In the process according to the invention, fuel is combusted in two stages. In the first stage, a substoichiometric amount of combustion air, approximately 70–80% of the stoichiometrically required combustion air, is mixed with fuel. It has been found that an increase in mixing intensity, or in other words smaller characteristic mixing time, results in a reduction of $NO_x$ emissions, if the gas residence time in the substoichiometric part of the flame is sufficiently large. As mentioned, the high mixing intensity of the fuel with the combustion air assists in suppressing the formation of soot and particulates.

DETAILED DESCRIPTION OF THE INVENTION

In order to describe the invention in greater detail, reference is made to the accompanying drawing in which FIG. 1 shows a longitudinal section of an apparatus employed to carry out the invention;

FIG. 2 shows cross-section 2—2 of FIG. 1;

FIG. 3 shows on a large scale a perspective view of the radial bluff sections shown in FIG. 1;

Figure 1:
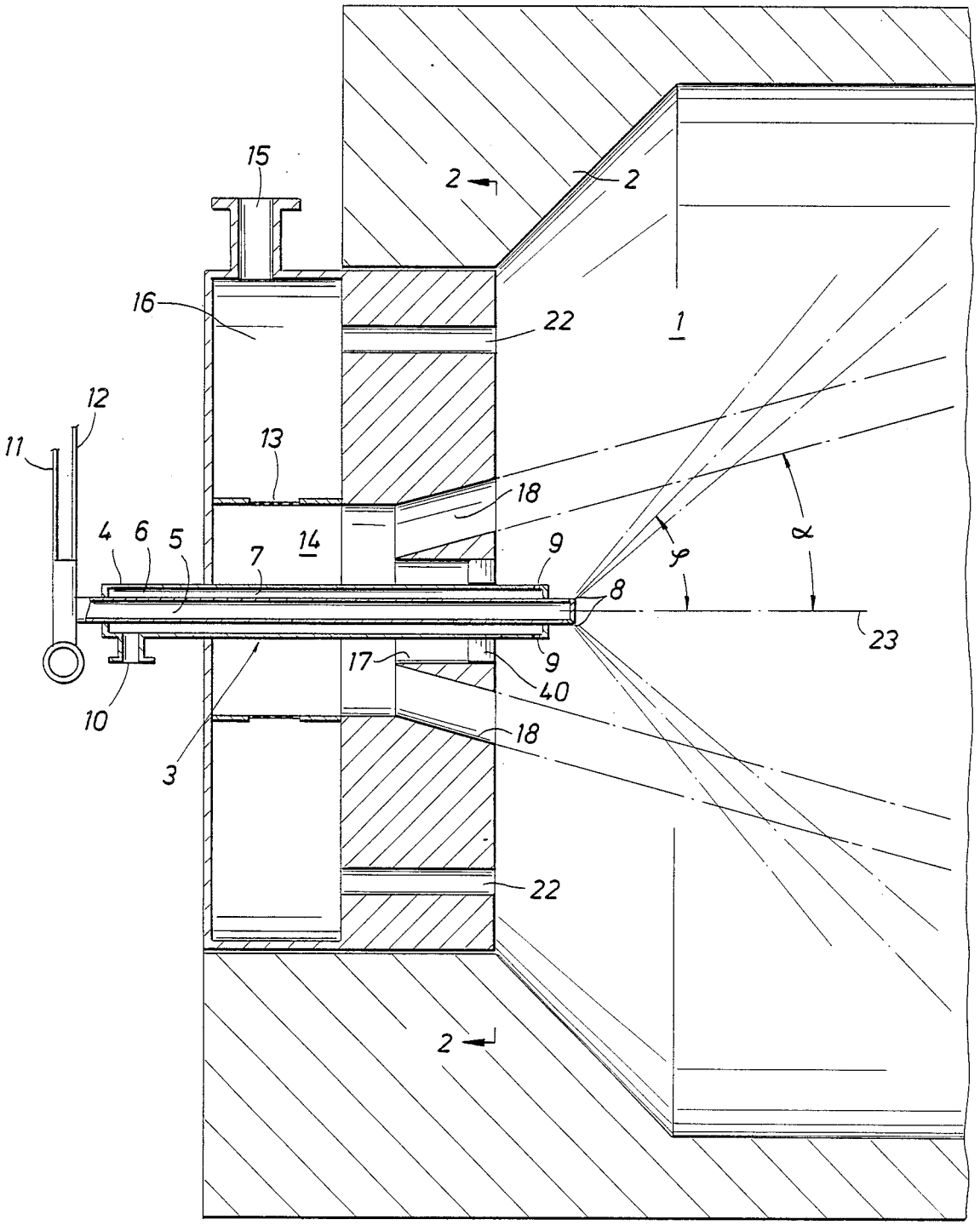

Referring to FIG. 1, reference numeral (1) indicates a combustion chamber, for example a boiler, bounded by a refractory-lined or membrane cooled wall (2). A burner (3), having its downstream end arranged in combustion chamber (1), passes through an opening in the wall (2). Burner (3) comprises a burner gun (4), which has as main components a supply tube (5) for fuel and atomizing steam, the tube (5) being surrounded by a supply tube (6) for fuel gas. An annular space (7) between the supply tubes (5) and (6) serves for the supply of purge air. Supply tube (5), which extends beyond supply tube (6), is at its downstream end provided with a plurality of outlet nozzles (8) for the discharge of atomized fuel into the combustion space. Supply tube (6) is in the same manner provided with a plurality of outlet nozzles (9) at its downstream end. The outlet nozzles (8)/(9) are substantially uniformly distributed around the periphery of supply tube (5)/(6) in such a manner, that, during operation, the sprays from the nozzles are laterally outwardly directed. It may be observed that when designing the burner end, care must be taken that the nozzles (8) are sufficiently spaced apart from each other, in order to prevent merging of fuel sprays during operation of the burner. For supplying fuel gas into tube (6), an inlet (10) is provided; atomizing steam and liquid fuel are injected into the supply tube (5) via inlet conduits (11) and (12), respectively.

The burner (3) further comprises an air register (13) surrounding the burner gun (4), the register being provided with openings through which combustion air or other free oxygen-containing gas may be blown into an air chamber (14). As used herein, the term combustion air includes any free oxygen-containing gas.

Although not shown in detail in FIG. 1, the air register (13) may consist of a plurality of blades substantially tangentially arranged with respect to the circumference of the air chamber (14) and spaced apart from each other to form openings for the passage of combustion air. An inlet (15) is provided for the supply of combustion air into a windbox (16) communicating with the air chamber (14) via the air register (13). The fluid communication between the air chamber (14) and the combustion chamber (1) is formed by a plurality of separate passages, which will now be discussed in greater detail.

The first combustion air passage is formed by an annular channel (17), which is arranged directly around supply tube (6), and which is internally provided with a plurality of swirl imparting vanes (40) (see FIG. 2). A plurality of outwardly inclined passages (18) are substantially uniformly distributed around the annular channel (17). The number of passages (18) correspond with the number of outlet nozzles (8) and (9), while each passage is positioned such that, during operation, each air jet from a passage (18) meets one fuel jet from an outlet nozzle (8) or (9). The passages (18) for combustion air are formed by partially blanking off the annular space formed between two substantially concentric walls (19) and (20). As shown in FIG. 3, the annular space is partially blanked off by a plurality of bluff bodies (21) extending over the length of the walls (19) and (20). In order to prevent the formation of constrictions in the airflow, the bluff bodies (21) are so shaped that the cross-sectional area of the passages (18) gradually decreases in downstream direction. A further advantage of the downstream decreasing of cross-sectional areas of the passages (18) consists that the required air pressure in the windbox (16) can be minimized. Finally, a plurality of air passages (22) are arranged in the front part of the burner for supplying secondary air from the windbox (16) into the combustion chamber (1). These passages (22) extend substantially parallel to the main burner axis (23) and are substantially uniformly distributed around said axis. The number of passages (22) correspond with the number of outlet nozzles (8), which latter number is equal to the number of outlet nozzles (9), as mentioned in the above.

The operation of the process of the invention with the above described burner is as follows. Liquid fuel is supplied through conduits (11) and (12) into supply tube (5), while, simultaneously, atomizing steam is added. The required combustion air is introduced into the burner via the air inlet (15). The purpose of the atomizing steam is to promote the formation of fine fuel droplets in the combustion chamber. The liquid fuel enters into the combustion chamber (1) via the outlet nozzles (8) in the form of a plurality of spray jets of fine fuel droplets. The size of these droplets depends on the shape of the outlet nozzles and the amount of atomizing steam applied. Due to the inclination of the outlet nozzles (8) with respect to the burner axis (23), the fuel jets are directed laterally outwards. The momentum flows of the fuel sprays and the angle $\rho$, i.e., the angle with the burner axis of the fuel jets should be selected such that each fuel jet merges into a combustion air jet from a passage (18). As indicated in FIG. 1, the jets of combustion air leaving the passages (18) make an angle $\alpha$ with the burner axis. The angles $\rho$ and $\alpha$ must be brought into accord with one another so that the resulting flame jet angle is such that the jet flames formed after ignition do not merge into one another, but will follow individual trajectories without influencing each other.

A criterion for the generation of the individual jet flames is that $$\frac{P_j(x)}{d_j(x)},$$

in which formula x is the downstream distance from the burner along the burner axis, $P_j$ is the distance between two adjacent jet axes (i.e., the pitch), and $d_j$ is the jet diameter when assuming a top hat velocity profile, should be at least 1.58.

It has been found that the emission of particulates and soot can be minimized by decreasing the so-called characteristic mixing time, increasing the angle of impingement of the fuel with the air, and increasing the combustion air velocity. The characteristic mixing time ($\tau_m$) can be expressed with the formula $$\tau_m = \left(\frac{4}{\pi\rho_\infty}\right)^2 \cdot \frac{(\dot{m}_l + \dot{m}_a)^2}{\dot{G}}$$

wherein $\dot{m}_l$ = liquid fuel mass flow per outlet nozzle, $\dot{m}_a$ = atomizing gas mass flow per outlet nozzle, $\rho_\infty$ = ambient gas density, $\dot{G}$ = total momentum flow per outlet nozzle.

While applicant has no desire to be bound by a theory of the invention, insofar as the minimization of soot and particulates emissions are concerned, the following explanation may be given.

Residual fuels contain residual carbon, present in the non-volatile hydrocarbon components of the fuel. When heat is supplied to the fuel droplets, vaporization will start if a certain surface temperature has been reached. The lighter hydrocarbons will vaporize first at the droplet-surface, resulting in a higher concentration of heavy liquid hydrocarbons at the droplet-surface and finally in a shell around the droplet with a high tensile strength. At the moment this shell is formed, the pressure inside the droplet will increase. The pressure increase depends on the heat flux. A higher heat flux causes a faster pressure increase. At high heat fluxes, the shell thickness is growing fast and very high pressures are built up inside the droplet. Due to the high internal pressures, the initial droplet will be broken down into smaller droplets. If the characteristic mixing time and/or air velocity is increased, the heat flux to the droplets is increased, which results in disruptive atomization.

Figure 4:
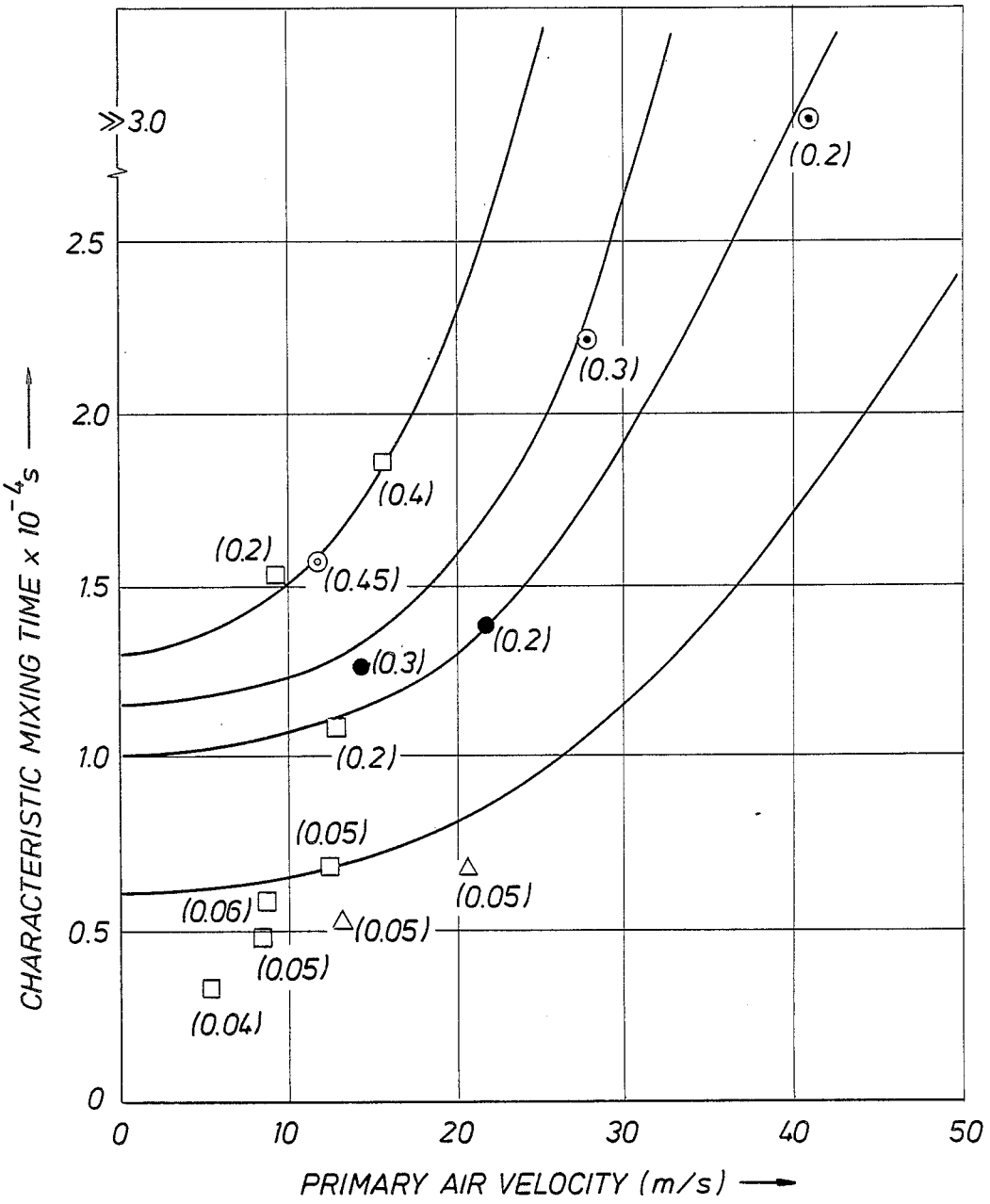
FIG. 4 shows a diagram illustrating the influence of characteristic mixing time and air velocity on the emission of particulates.

Tests have been carried out to investigate the influence of characteristic mixing time and air velocity on the emission of particulates. The results of these tests are given in FIG. 4, which shows a diagram in which the characteristic mixing time has been plotted on the X-axis, and the primary air velocity on the Y-axis. The diagram, in which the particulate emissions are indicated between brackets, shows the test results carried out with different burner types. The tests were carried out with a fuel of 3500 s Redwood at 20 cst. From this diagram, it can be seen that at characteristic mixing times of below about $1\times10^{-4}$ sec., the particulates emission is very low, in the order of magnitude of 0.05% by weight of the fuel. The tests have also demonstrated that, at a given characteristic mixing time, an increase of the air velocity has a favorable influence on the reduction of particulates emission.

The above requirements as to the characteristic mixing time and air velocity to reduce or minimize particulates emission, which may be explained by the phenomenon of disruptive atomization, are also advantageous for reducing soot emission. Soot, visible as black plumes from the stack of a combustion unit, is formed by pyrolysis of hydrocarbon vapors. At high temperatures, the hydrocarbon molecules fall apart in active nuclei, having the tendency to grow as a function of time due to coalescence. Later the coalesced particles will polymerize and soot particles in the submicron range are formed. To reduce soot emission, the active nuclei and the formed soot particles should be attached with oxygen atoms as fast as possible. The small characteristic mixing time and high air velocity required for minimal particulates emission will also be helpful for a fast attack of these active nuclei and formed soot particles with oxygen atoms, and are therefore very advantageous for reducing soot emission.

A further requirement in the combustion of heavy fuel is the restriction of emission of NOx. Nitrogen oxides can be formed via different routes. Thermal NOx is formed via reactions between the nitrogen in the combustion air and the available oxygen. Fuel NOx is formed from organically bound nitrogen in the fuel.

Figure 5:
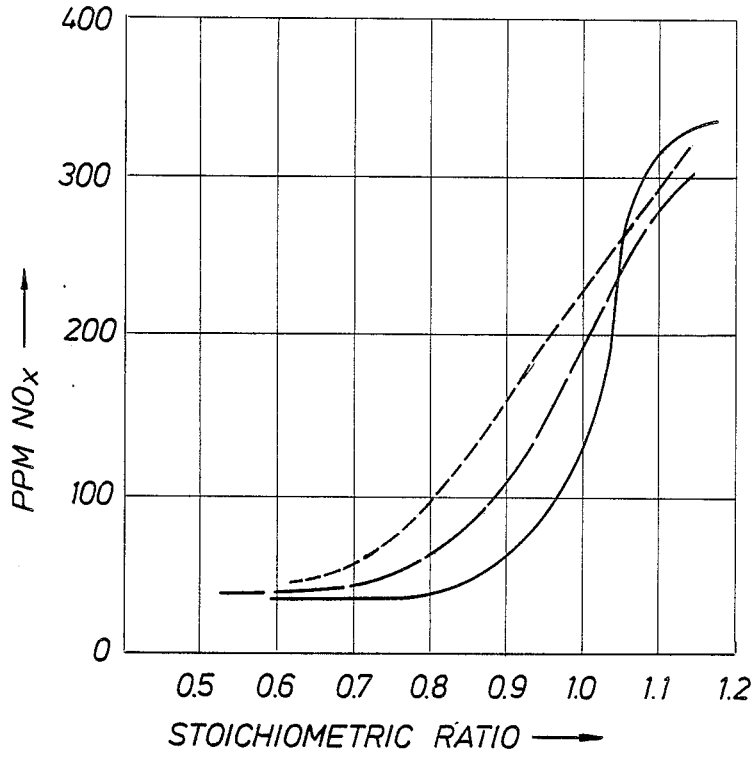
FIG. 5 shows a diagram illustrating the emission of $NO_x$ versus the stoichiometric ratio of combustion air.
Figure 6:
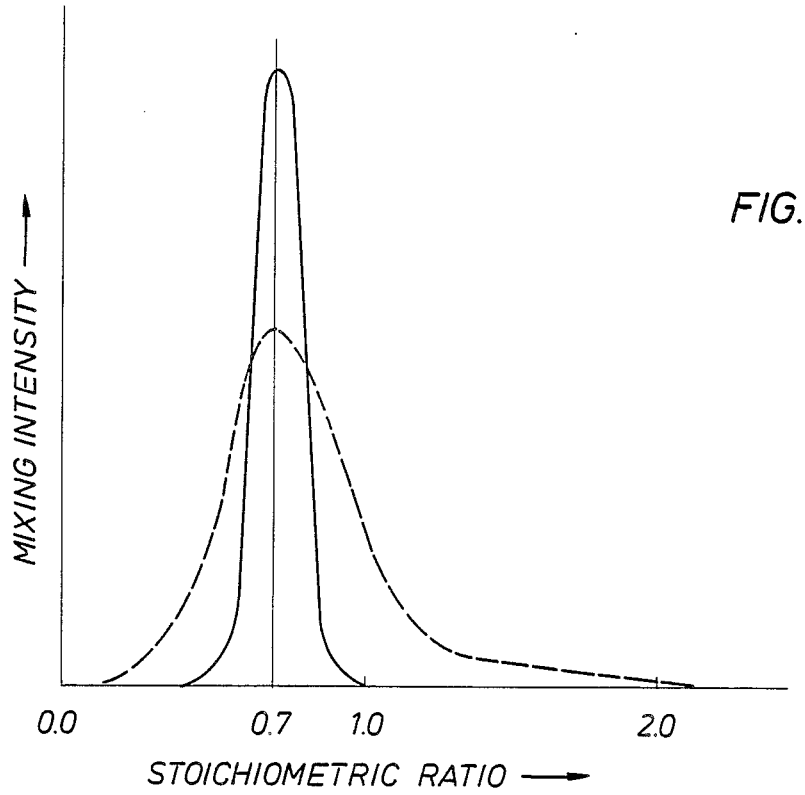
FIG. 6 shows a diagram illustrating the distribution of combustion reactions versus the stoichiometric ratio of combustion air.

It has been found that, with two stage combustion, the formation of NOx decreases with a decrease of the rate of combustion air in the first combustion stage. This decrease is promoted by a high mixing intensity of the fuel with the combustion air. FIG. 5 shows the emission of NOx versus the stoichiometric ratio of the combustion air, i.e., ratio of the amount of available air versus the amount of combustion air for complete combustion, for three different burner types. The application of a two stage combustion method wherein a substoichiometric amount of air is used in the primary combustion stage can help to reduce the formation of fuel NOx. Even when using such a two stage method, combustion processes still occur over a wide range in the stoichiometric ratio domain if the mixing intensity is kept low. When increasing the mixing intensity of the fuel with the primary air, the distribution of the combustion over the stoichiometric domain becomes less wide. This phenomenon is shown qualitatively in FIG. 6. The dotted line illustrates the distribution of combustion reactions when a low mixing intensity is applied. For a high mixing intensity the situation of the distribution of combustion reactions is illustrated by the uninterrupted line in FIG. 6. In both cases, the overall stoichiometric ratio of the fuel/mixture was chosen to be equal to 0.7.

A further requirement for lowering the fuel NOx emission is a sufficiently long residence time of the fuel in the substoichiometric combustion stage. It has been found that for stoichiometric ratios between 0.7 and 1.0 in the primary combustion stage, a substantial reduction in fuel NOx formation can be obtained by increasing the residence time in said primary combustion stage. A residence time of about 100 ms will be appropriate for reducing NOx emission. However, this requirement is in direct contradiction with the high air velocities which are preferred, as discussed above. To achieve a relatively long residence time at high primary air velocities, the primary air is split up into a plurality of individual, non-interacting jets to produce a relatively long residence time in each substoichiometric flame.

In two stage combustion processes, the risk of the formation of thermal NOx mainly consists in the secondary combustion stage. By maintaining the temperature in the secondary combustion stage at a moderate level, the formation of thermal NOx can be restricted. In the method according to the invention, high velocity substoichiometric flame jets are produced which entrain a relatively large quantity of cool ambient gas in the combustion chamber (1), so that the temperature is keep relatively low at the moment the secondary combustion air is added to the flame jets.

The arrangement of the various air supply channels should be chosen such that approximately 70–80% of the stoichiometric air requirement is fed to the combustion chamber (1) via the air passages (18), with preferably a velocity of at least 40 m/sec, even more preferably a velocity of at least 60 m/sec. This high air velocity requirement determines the required air pressure in the windbox (16). To reduce the air pressure in windbox (16), the passages (18) are so shaped as to taper in downstream direction, as mentioned previously. To promote the mixing intensity of the fuel jets with the primary air jets, jets are preferably arranged obliquely with respect to one another. The angle between the fuel jets and the primary air jets is suitably at least 70 degrees. If very large angles can be accomodated, the angles $\alpha$ of the air jets may be even chosen equal to zero. In this latter case, the air passages (18) can be arranged parallel to the main burner axis (23).

A further part of the combustion air introduced in the windbox (16) will enter into the combustion chamber (1) via the annular channel (17). This annular channel (17) is so dimensioned that approximately 15% of the stoichiometric air requirement is passed through said channel, in which channel the air is brought into rotation via the vanes (40). This swirling air is used for ignition of the spray jets emerging from the outlet nozzles (8). The remaining part of the combustion air, serving for complete combustion of the fuel, is introduced into the combustion chamber (1) via the secondary air passages (22), which are so positioned with respect to the fuel/primary air jets formed in the first combustion stage that each air jet from a passage (22) will meet a fuel/primary air jet after a gas residence time in said latter jet of at least about 100 ms, in order to minimize the formation of NOx discussed above. Finally, purge air is supplied around the outlet nozzles (8), via the annular space (7) between the fuel supply tubes (5) and (6). The object of this purge air is to prevent fouling of the outlet nozzles (8), which might occur due to deposits of fuel droplets from the fuel jets emerging from said outlet nozzles.

It should be noted that the invention is not restricted to a specific number of fuel passages and primary air passages. The required fuel throughput determines the minimum number of fuel passages which can be applied without a substantial increase of the formation of particulates, soot and NOx. The maximum number of outlet nozzles is, inter alia, determined by the requirement of the formation of independent fuel/air jets in the first combustion stage and the requirement that flame impingement to the burner gun or the wall of the combustion chamber be prevented.

Instead of the supply of secondary air via a plurality of separate passages, the secondary air may also be introduced into the combustion chamber as a ring around the substoichiometric fuel/air jets. It should be note that the substoichiometric fuel/air jets may merge into one another after a gas residence time in the fuel-/air jets of at least about 100 ms. In this manner, a single flame is formed at a relatively long distance from the burner (2), into which flame the secondary air is introduced. The secondary air may then be injected into the combustion chamber via, for example, a single, eccentrically arranged air passage.

Although in the embodiment shown in FIG. 1 primary and secondary air are supplied into the combustion chamber 1 via a single air source formed by windbox 16, the primary and secondary air may also be introduced via separate air sources.

What is claimed is:

1. A process for combustion of a liquid fuel comprising combusting said fuel initially with a substoichiometric amount of air in a combustion chamber, the fuel and combustion air being introduced, respectively, in an equal number of fuel jets and high velocity combustion air jets into the chamber in such manner that (a) each fuel jet merges into one high velocity air jet, (b) the characteristic mixing time of each fuel jet with each therefor air jet is less than about $10^{-4}$ sec, and (c) a plurality of separate fuel/air jets are generated forming at ignition a plurality of primary flames in which a residence time for the fuel of substantially at least 100 ms is maintained;

and introducing additional combustion air into said chamber for complete combustion of the fuel.

2. The process of claim 1 wherein the velocity of the combustion air jets injected into the combustion chamber is substantially at least 40 m/s.

3. The process of claim 2 wherein the velocity of the combustion air jets injected into the combustion chamber is substantially at least 60 m/s.

4. The process of claim 3 wherein each fuel jet and accompanying combustion air jet are directed at an angle of at least about 70 degrees with respect to one another.

5. The process of claim 4 wherein the additional combustion air is injected into the combustion chamber in the form of a plurality of air jets, each of which jets is directed towards one primary flame.

6. The process of claim 1 wherein the fuel is a heavy hydrocarbonaceous liquid fuel.

7. The process of claim 2 wherein the fuel is a heavy hydrocarbonaceous liquid fuel.

8. The process of claim 3 wherein the fuel is a heavy hydrocarbonaceous liquid fuel.

9. The process of claim 4 wherein the fuel is a heavy hydrocarbonaceous liquid fuel.

10. The process of claim 5 wherein the fuel is a heavy hydrocarbonaceous liquid fuel.

* * * * *